US006004140A

United States Patent [19]

Kato et al.

[11] Patent Number: 6,004,140

[45] Date of Patent: Dec. 21, 1999

[54] FEMALE ELECTRIC CONNECTOR

[75] Inventors: Takahira Kato; Tatsuya Seto, both of Kariya; Satoru Tamura, Anjo, all of Japan

[73] Assignee: Denso Corporation, Kariya, Japan

[21] Appl. No.: 09/134,755

[22] Filed: Aug. 17, 1998

[30] Foreign Application Priority Data

Oct. 9, 1997 [JP] Japan ..... 9-277737

[51] Int. Cl.[6] ..... H01R 9/09

[52] U.S. Cl. ..... 439/65; 439/637

[58] Field of Search ..... 439/65, 630, 637, 439/638, 374, 378, 377

[56] References Cited

U.S. PATENT DOCUMENTS

| | | | |
|---|---|---|---|
| 2,825,037 | 2/1958 | French | 439/65 |
| 4,692,120 | 9/1987 | Feinstein | 439/65 |
| 5,244,395 | 9/1993 | DeSantis et al. | 439/65 |
| 5,455,742 | 10/1995 | Phoy et al. | 439/65 |
| 5,629,839 | 5/1997 | Woychik | 439/65 |

FOREIGN PATENT DOCUMENTS 1-248590 10/1989 Japan .

2-161792 6/1990 Japan .

*Primary Examiner*—Khiem Nguyen
*Assistant Examiner*—T C Patel
*Attorney, Agent, or Firm*—Pillsbury Madison & Sutro

[57] ABSTRACT

A female connector to be coupled with a male connector of an electric device and an external circuit board. The female connector is composed of a case member to be inserted into a coupling hole of the circuit board, a pedestal portion extending outward from the case member in a direction perpendicular thereto, a plurality of terminal members disposed in the case member, and at least a pair of projection members extending from opposite sides of the pedestal portion toward the coupling hole of the circuit board. The case members have a plurality of parallel slits, and the pedestal member has a plurality of parallel grooves connected to the slits. The terminal member has a base portion inserted in one of the grooves, a first terminal portion inserted to one of the slits and a second terminal portion extending from the base portion toward the external circuit board. The first and second terminal portions are disposed in contact with terminal plates of the electric device and the circuit board under pressure respectively when the female connector is coupled with the male connector.

6 Claims, 6 Drawing Sheets

FEMALE ELECTRIC CONNECTOR

CROSS REFERENCE TO RELATED APPLICATION

The present application is based on and claims priority from Japanese Patent Application No. Hei 9-27737, filed on Oct. 9, 1997, the contents of which are incorporated herein by reference.

BACKGROUND OF THE INVENTION

1. Field of the Invention

The present invention relates to a connector applicable to an analogue type indicating instrument and other electric devices.

2. Description of the Related Art

In an analogue type indicating instrument for a vehicle, a circuit board for driving a step-motor and an external circuit board are disposed in parallel with each other and connected by a wire harness to each other.

The connection is carried out by soldering or screw-fastening the ends of the wire harness to the circuit boards. Once the circuit boards are connected by soldering or screw-fastening, it takes time to disconnect one from the other.

SUMMARY OF THE INVENTION

The present invention has an object of providing an improved connector which is easily to connect two circuits board each other or disconnect one circuit board from the other.

According to a main feature of the present invention, a female connector to be coupled with a male connector of an electric device and an external circuit board is composed of a case member to be inserted into a coupling hole of the circuit board, a pedestal portion extending outward from the case member, a plurality of terminal members disposed in the case member, and at least a pair of projection members extending from opposite sides of the pedestal portion toward the coupling hole of the circuit board. In the above structure, one of walls of the case member has a plurality of parallel slits extending in the direction perpendicular to the circuit board, and the pedestal member has a plurality of parallel grooves extending in the longitudinal direction to be connected to the plurality of slits respectively. Further, each of the terminal members has a base portion inserted in one of the grooves, a first terminal portion extending from the base portion to be inserted to one of the slits and a second terminal portion extending from the base portion toward the circuit board, and the first and second terminal portions are in contact with terminal plates of the electric device and the circuit board under pressure respectively when the female connector is coupled with the male connector and the circuit board.

Therefore, the female connector can be coupled with or removed from the male connector easily without any additional member or tool.

The above female connector may have a plurality of other terminal members disposed in the case member symmetrically to first-said terminal members.

The above female connector may also have an outside member for accommodating the case member to be movable within a suitable amount of play. In this female connector, it is possible that the case member has a projection member and that the outside member has holes in engagement with the projection member. Further, it is possible that the pedestal portion has a hook member and a wall member disposed in the grooves and that the base portion of the terminal members has an edge portion held in the grooves retained by the hook member and the wall member.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

A female connector according to a preferred embodiment of the present invention is described with reference to FIGS. 1–9.

Figure 1:
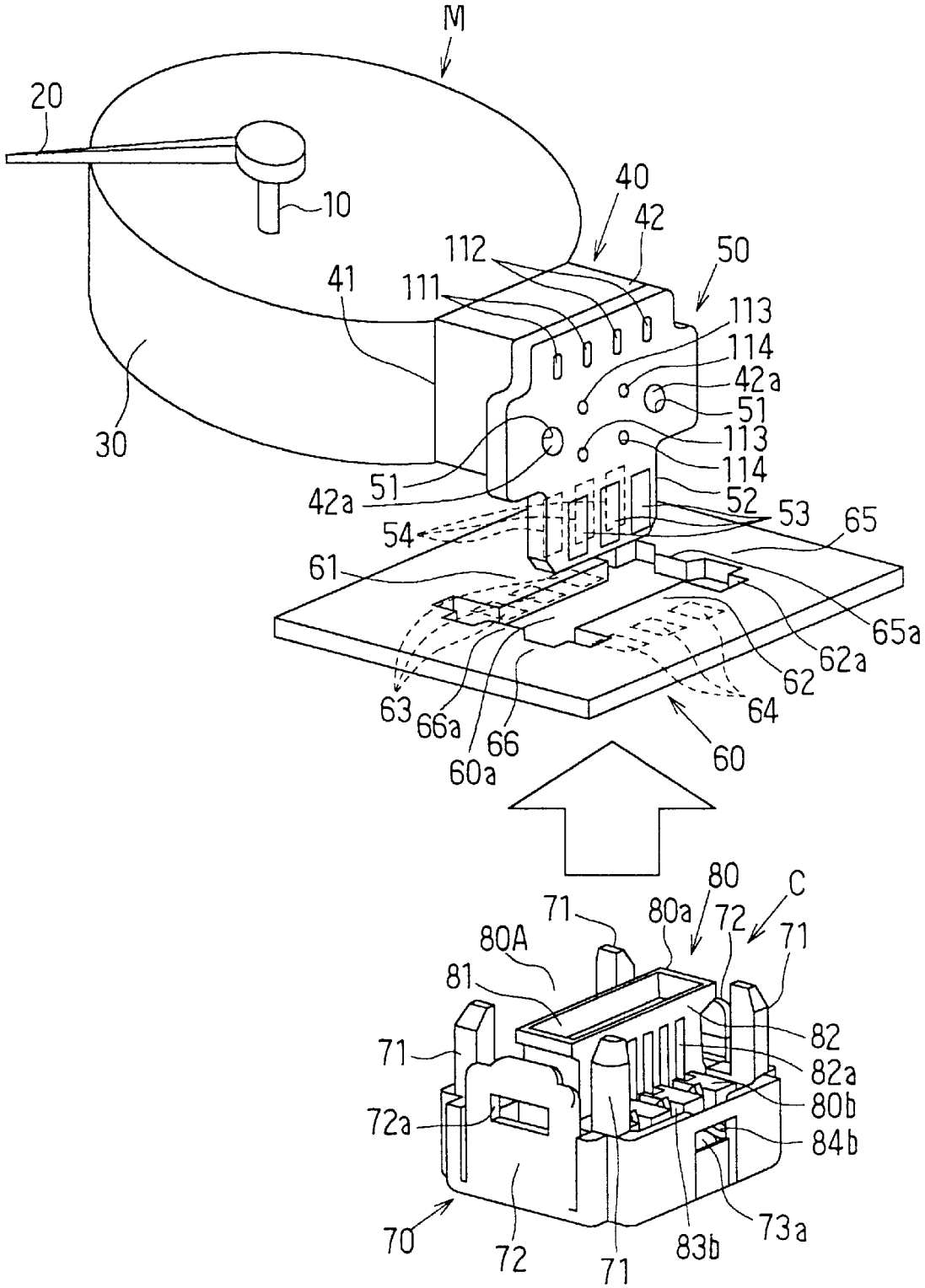
FIG. 1 is an exploded perspective view of an indicating instrument, an external circuit board and a female connector according to an embodiment of the invention.

In FIG. 1, an analogue type speed meter has step motor M which is fixed to the back of a dial plate (not shown). Step motor M has rotary shaft 10 carrying luminous pointer 20 on one end thereof.

Luminous pointer 20 has a light emitting diode (not shown) at the base thereof and emits light from a slit formed on the upper surface thereof to display a measurement.

Step motor M has cylindrical housing 30, which has an opening formed on the outer periphery thereof. A terminal cover 40 is fixed to inner opening 41 of terminal cover 40 made of thermoplastic resin such as polybutylene terephtalate.

Terminal cover 40 accommodates a connector made of insulating resinous material (not shown) that holds two pair of terminals 111, 112 for energizing the light emitting diode and two pair of terminals 113, 114 for energizing step motor M. The pair of terminals 111 is connected to the anode of the light emitting diode, and the pair of terminals 112 is connected to the cathode thereof. On the other hand, the pairs of terminals are respectively connected to input terminals for two-phase windings of step motor M.

Circuit board 50 for step motor M is fixed to outside opening 42 of terminal cover 40. Circuit board 50 has a pair of fixing holes 51 and terminal cover 40 has a pair of projections 42*a* extending therefrom to be fitted into the pair of fixing holes 51. Projections 42*a* are thermally welded to fixing holes 51. Circuit board 50 has four slits at upper portions thereof to which terminals 111, 112 are inserted and four round holes at central portions thereof to which terminals 113, 114 are inserted as illustrated in FIG. 1. Circuit board 50 also has flat male connector portion 52 extending downward from an opening (not shown) of the bottom of casing.

Three terminal plates 53 are fixed on the front side of male connector portion 52 and three terminal plates 54 are fixed on the backside thereof. Two of three terminal plate 53 are respectively connected to the pair of terminal 113 via a circuit pattern (not shown), and two of three terminal plates 54 are respectively connected to the pair of terminal 114 via another circuit pattern (not shown). The rest of terminal plates 53 is connected to the pair of terminals 111 via a circuit pattern (not shown), and the rest of terminal plates 54 are connected to the pair of terminals 112 via another circuit pattern (not shown).

Circuit board 60 connects an external circuit (not shown) through female connector C, connector portions of both circuit board 50 and terminal cover 40 to the light emitting diode and the stator winding (phase windings).

Circuit board 60 is disposed under the bottom of the casing to be perpendicular to male connector portion 52. Circuit board 60 has generally rectangular opening 60*a*, through which male connector portion 52 and female connector C are coupled and male connector portion 52 is connected to the external circuit.

Figure 2:
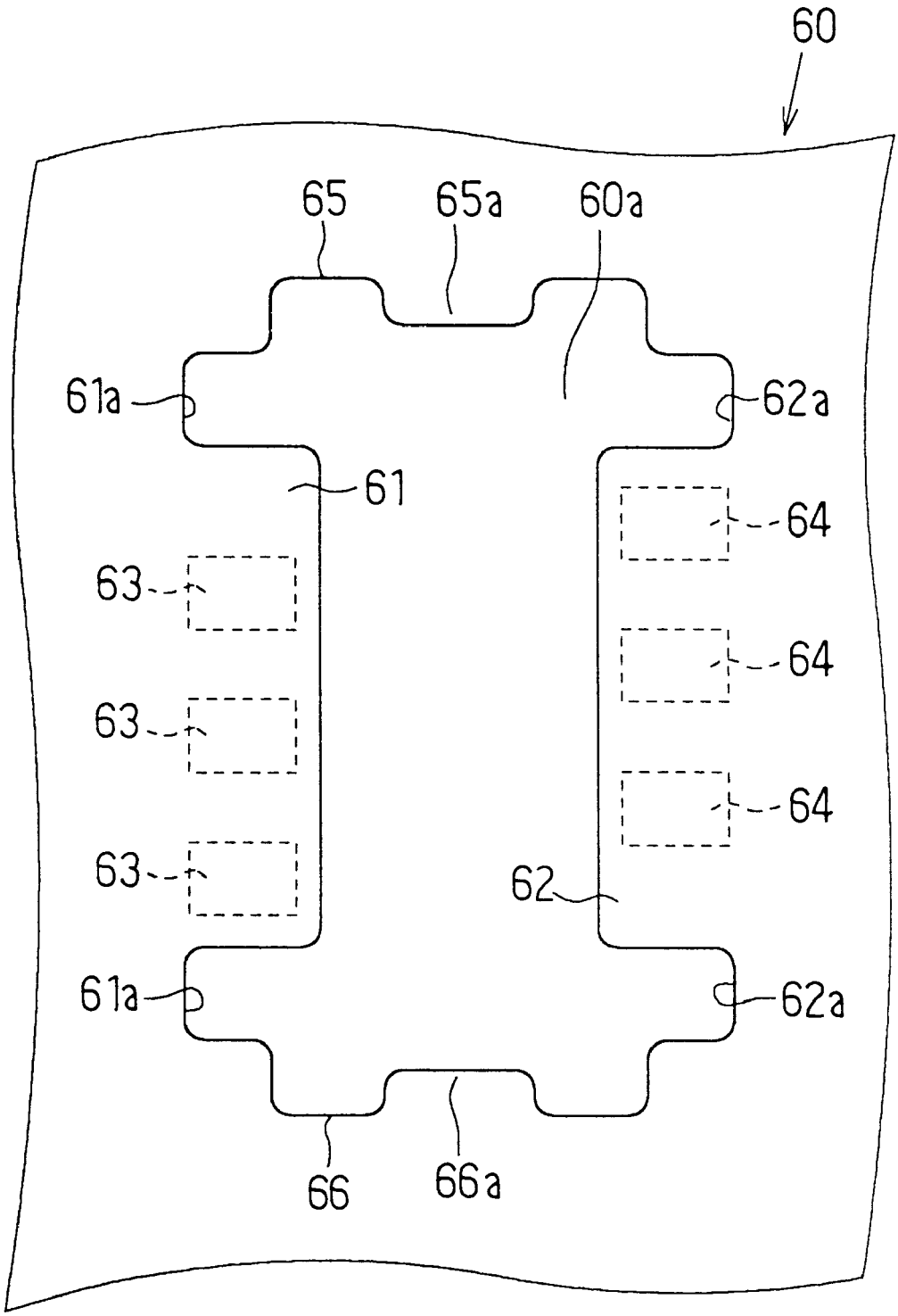
FIG. 2 is a plan view illustrating a main portion of an external circuit board to be connected to the connector shown in FIG. 1.

Coupling hole 60*a* has a pair of side-convex portions 61, 62 formed on the opposite sides thereof and a pair of end-convex portions 65*a*, 66*a* formed on the opposite ends thereof as shown in FIG. 2. Three terminal plates 63 are formed on the back surface of side-convex portion 61 of coupling hole 60*a*, and three terminal plates 64 are formed on the back surface of opposite side-convex portion 62 thereof. Each of terminal plates 63 shifts longitudinally (downward in FIG. 2) from corresponding one of terminal plate 64 by a width of one of terminal plates 64.

A pair of side-concave portions 61*a* is formed at the opposite ends of side-convex portion 61, and a pair of side-concave portions 62*a* is formed at the opposite ends of side-convex portion 62. A pair of end-concave portions 65 is formed on the opposite sides of end-convex portion 65*a*, and a pair of end-concave portions 66 is formed on the opposite sides of end-convex portion 66*a*.

Figure 3:
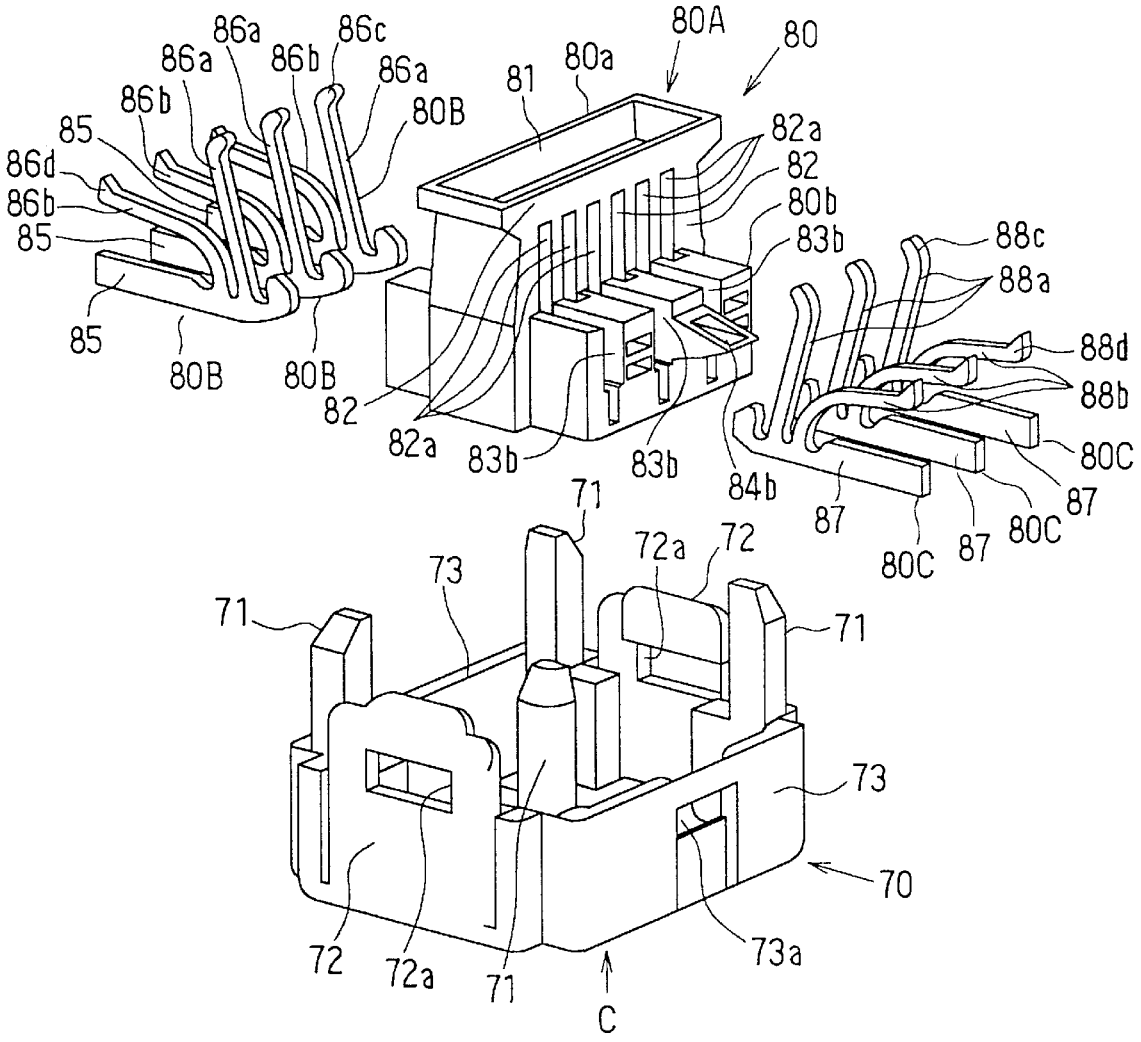
FIG. 3 is an exploded perspective view of the female connector according to the embodiment.

Female connector C is composed of outside connector member 70 and inside connector member 80, both made of elastic insulation material, as shown in FIG. 1 and FIG. 3.

Outside connector member 70 has a pair of end walls 72, a pair of side walls 73 and four rectangular poles 71 extending upward from the respective corners of a rectangular opening surrounded by walls 72, 73 as shown in FIG. 3. Four rectangular poles 71 are to be fitted into side-concave portions 61*a*, 62*a* respectively to be elastically held therein.

End walls 72 have engagement holes 72*a* respectively. When outside connector member 70 is inserted into coupling hole 60*a* of circuit board 60, end walls 72 bend elastically until end-convex portions 65*a*, 66*a* are fitted to the pair of engagement holes 72*a*.

Figure 4:
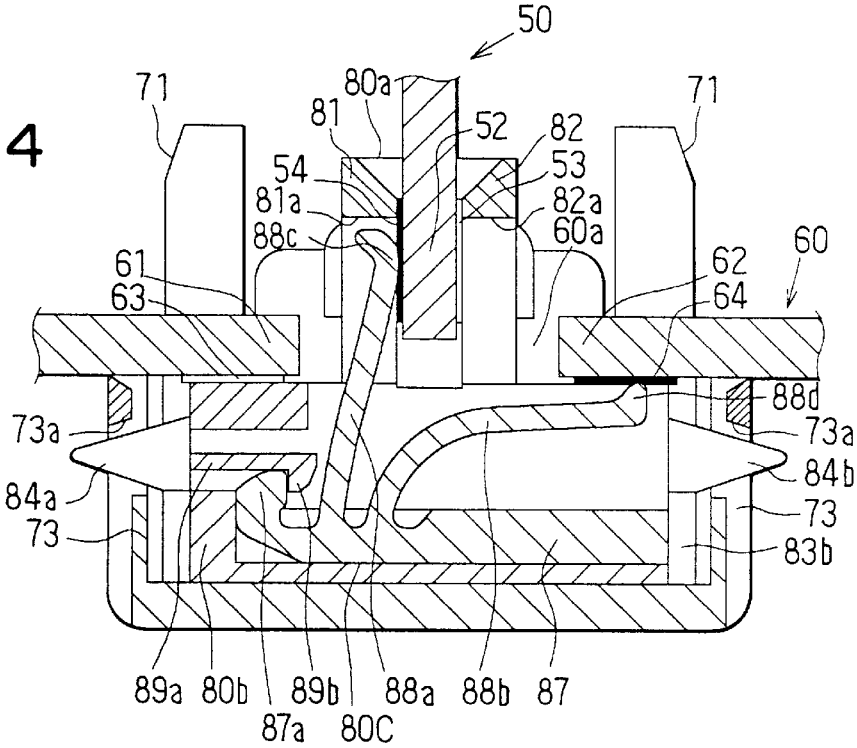
FIG. 4 is a cross-sectional side view of a portion of the female connector illustrated in FIG. 6 cut along line 4—4.
Figure 5:
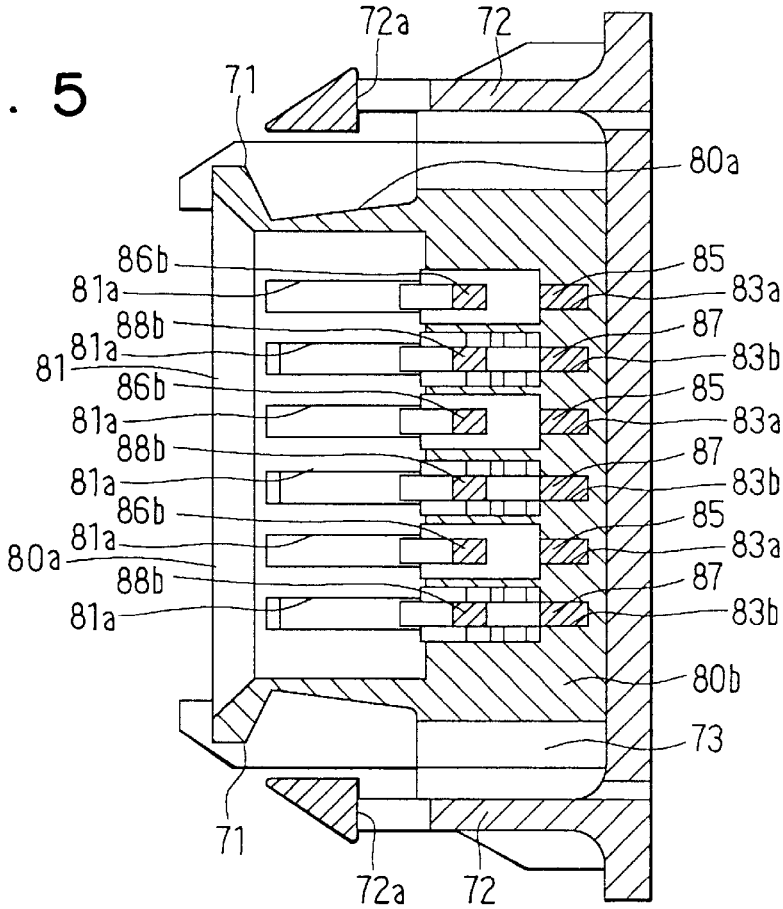
FIG. 5 is a cross-sectional side view of a portion of the female connector illustrated in FIG. 6 cut along line 5—5.
Figure 7:
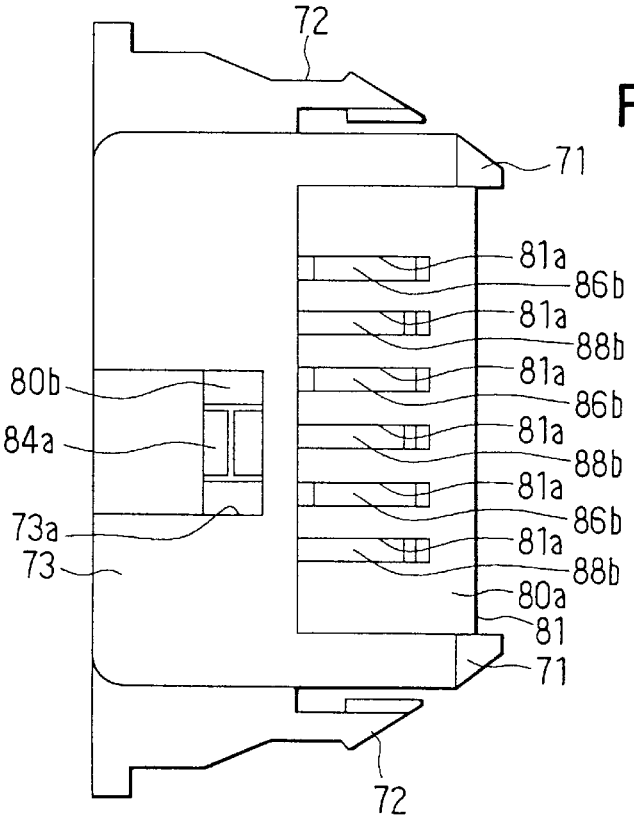
FIG. 7 is a left side view of the female connector illustrated in FIG. 6.
Figure 8:
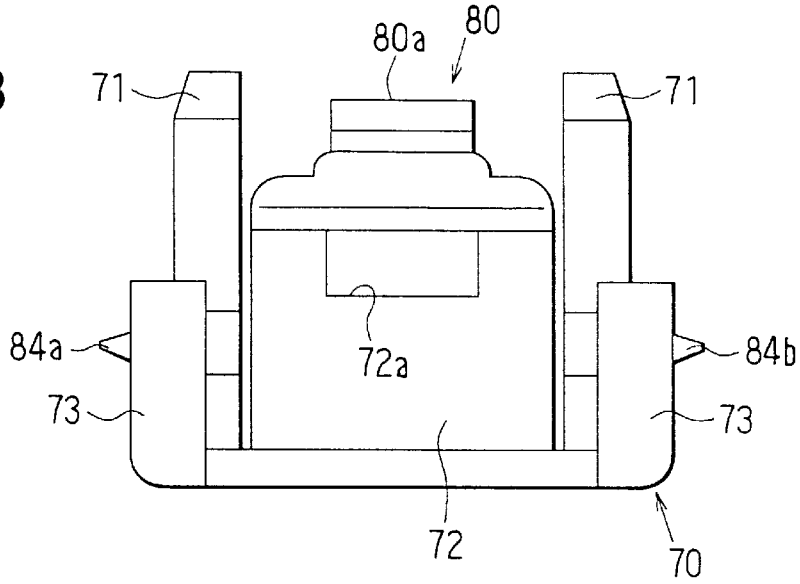
FIG. 8 is a bottom view of the female connector illustrated in FIG. 6.
Figure 9:
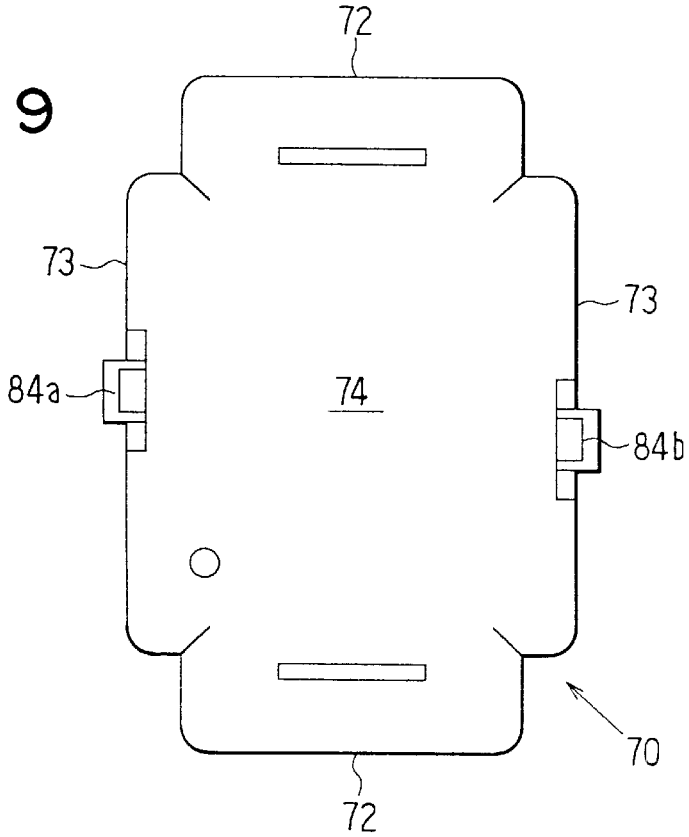
FIG. 9 is a back view of the female connector illustrated in FIG. 6.

Inside connector member 80 is composed of rectangular female connector member 80A, a group of three terminal members 80B and another group of three terminal members 80C. Female connector member 80A is made of insulating resinous material and has case portion 80*a* and pedestal portion 80*b* extending outward from opposite side walls of case portion 80*a* to form a reversed T-shape in cross-section as shown in FIG. 3. Female connector porion 80*a* has six parallel slits 81*a*, 82*a* on opposite side walls 81, 82 respectively as shown in FIGS. 4, 5 and 7. Each of slits 81*a* is formed to be opposed to one of slits 82*a* as shown in FIG. 4.

Pedestal portion 80*b* has three grooves 83*a* extending from one side thereof and three grooves 83*b* extending from the opposite side thereof, both, in the direction perpendicular to side walls 81, 82. As shown in FIG. 1 and FIG. 5, each of grooves 83*a*, 83*b* has narrower portion at the bottom thereof.

As shown in FIG. 4–7, each of three grooves 83*a* is connected with every second of slits 81*a*, 82*a* and each of three grooves 83*b* is connected with the rest of slits 81*a*, 82*a*.

Figure 6:
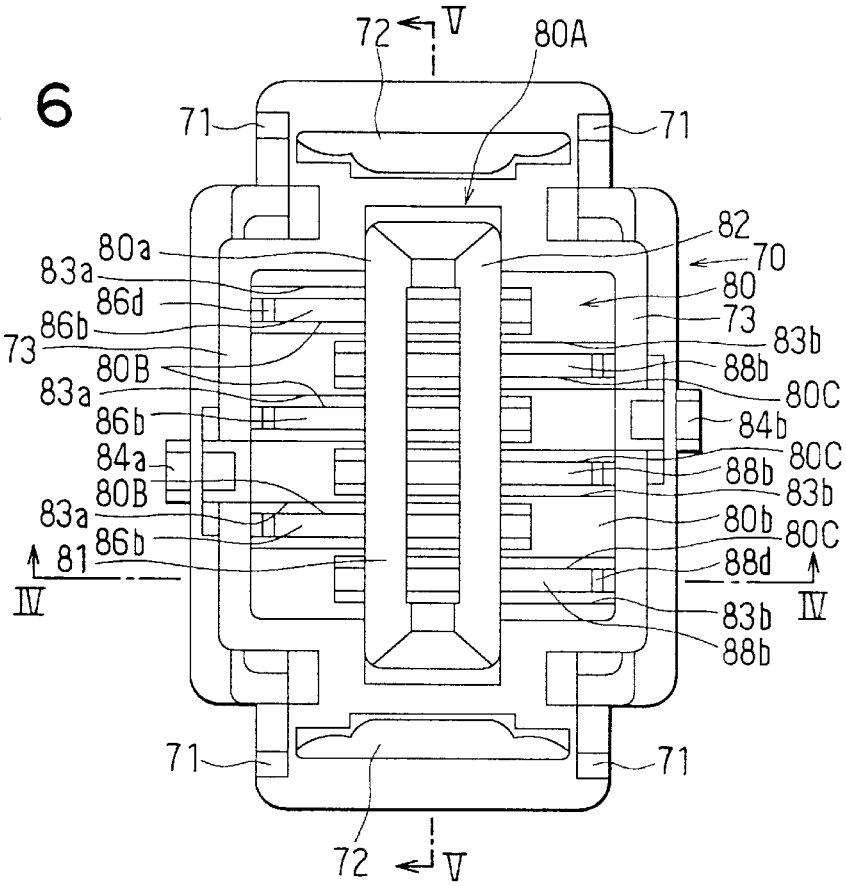
FIG. 6 is a plan view of the female connector illustrated in FIG. 1.

As shown in FIGS. 4 and 6, each of grooves 83*b* extends left from the right side of pedestal portion 80*b*, and each of grooves 83*a* extends right from the left side of pedestal portion 80*b*.

The open end of case portion 80*a* gradually opens as shown in FIG. 5 so that connector 52 can be introduced therein easily. As shown in FIGS. 3, 4, 6, 8 and 9, pedestal portion has a pair of tapered projections 84*a*, 84*b* at the opposite sides thereof. As shown in FIG. 6, projection 84*a* extends from a portion between lower two grooves 83*a* and engages rectangular holes 73*a* formed in left side wall 73 of outside connector member 70, and projection 84*b* extends from a portion between upper two grooves 83*b* and engages rectangular hole 73*a* formed in the right side wall 73.

The bottom area of outside connector member 70 is arranged to be larger than the bottom area of pedestal portion 80*b* thereby forming a suitable amount of play, so that pedestal portion 80*b* can move within some distance (e.g. 2 mm). The cross-sectional area of projections 84*a*, 84*b* is also arranged to be smaller than the open area of rectangular holes 73*a*, thereby forming a suitable amount of play, so that pedestal portion 80*b* can move along side walls 73 of outside connector member 70 within some distance (e.g. 2 mm).

Each of terminal members 80B is made of tinned phosphor bronze and, as shown in FIG. 3, is composed of flat base portion 85, upright first terminal portion 86*a* extending upward from base portion 85 and bowed (or J-shaped) second terminal portion 86*b* extending parallelly from base portion 85.

Each of terminal members 80C is the same in material and structure, which is composed of flat base portion 87, upright first terminal portion 88*a* and bowed second terminal 88*b*. As shown in FIGS. 4 and 6, lowermost one of base portions 87 is press-fitted to the narrower portion of one of grooves 83 so that the left side surface of edge 87*a* engages the left wall of groove 83*b* and upper portion of edge 87*a* engages hook 89*b* of hook member 89*a* extending from the left end of pedestal portion 80*b*.

The lowermost one of first terminal portions 88*a* is inserted into the lowermost one of slits 81*a*, and the lowermost one of second terminal portions 88*b* extends toward the right opening of groove 83*b*.

First terminal portion 88*a* and second terminal portion 88*b* have respective hook-shaped portion 88*c*, 88*d* at the edge thereof as shown in FIGS. 3 and 4. When male connector portion 52 is not inserted into case portion 80*a*, hook-shaped portion 88*c* extends into the inside of case portion 80*a* toward right side wall 82, and hook-shaped portion 88*d* projects upward from groove 83*b*. Hook member 89*a* extends from the left side wall of the lowermost one of grooves 83*b* in the longitudinal direction of groove 83*b* with hook 89*b* down.

The others of terminal members 80C have the same structure as the above. Terminal members 80B have also the same structure except that terminal members 80C are installed in case portion 80*a* symmetrically to terminal members 80B.

In FIG. 1, when female connector C is inserted into coupling hole 60*a* of circuit board 60 as indicated by an arrow, four rectangular poles 71 are elastically fitted to side concave portions 61*a,* 62*a*. Opposite end walls 72 are inserted to coupling hole 60*a* to bend along the inner peripheries of end-convex portions 65*a,* 66*a* until end-convex portions 65*a,* 66*a* engage engagement holes 72*a*.

Then, male connector portion 52 of circuit board 50 is fitted to case portion 80*a* of inside connector member 80. This can be done smoothly because of the above-mentioned plays. First terminal portions 86*a,* 88*a* are bent by the edge of male connector portion 52 to provide pressure against terminal plates 53, 54. Second terminal portions 86*b,* 88*b* are pressed by terminal plates 63, 64. Thus terminal plates 53, 54 of circuit board 50 and terminal plates 63, 64 of circuit board 60 are connected without other member or element such as solder or a screw.

Female connector C can be removed easily by pulling it from male connector portion 52 and coupling hole 60*a* of circuit board 60.

The connector described above can be applied to various devices for industrial use, home appliances or others.

In the foregoing description of the present invention, the invention has been disclosed with reference to specific embodiments thereof. It will, however, be evident that various modifications and changes may be made to the specific embodiments of the present invention without departing from the broader spirit and scope of the invention as set forth in the appended claims. Accordingly, the description of the present invention in this document is to be regarded in an illustrative, rather than restrictive, sense.

What is claimed is:

1. A female connector to be coupled with a male connector of an electric device having a first plurality of terminal plates and with a circuit board having a coupling hole and a second plurality of terminal plates, said female connector comprising:

a case member including first and second opposite wall members to be inserted into said coupling hole, said first wall member having a plurality of first parallel slits extending perpendicularly to said circuit board;

a pedestal portion extending outwardly from said wall members in a direction perpendicular thereto, said pedestal member having a plurality of first parallel grooves extending in the longitudinal direction thereof to be connected to said first plurality of slits respectively;

a plurality of terminal members disposed in said case member, each having a first base portion inserted in one of said first grooves, a first terminal portion extending from said first base portion to be inserted to one of said first slits and a second terminal portion extending from said first base portion toward said circuit board, said first and second terminal portions being in contact with said first terminal plates of said electric device and said second terminal plates of said circuit board under pressure respectively when said female connector is coupled with said male connector and said circuit board; and at least a pair of projection members extending from opposite sides of said pedestal portion toward said coupling hole of said circuit board.

2. The female connector as claimed in claim 1 further comprising a plurality of second terminal members disposed in said case member symmetrically to said first terminal members, each having a second base portion, a third terminal portion extending from said second base portion and a fourth terminal portion extending from said second base portion toward said circuit board, wherein said second wall member has a plurality of second slits;

said pedestal portion has a plurality of second parallel grooves extending in the longitudinal direction thereof to be connected to said second slits respectively;

each said second base portion is inserted in one of said second grooves, each said third terminal portion is to be inserted to one of said second slits;

said third and fourth terminal portions are in contact with third terminal plates of said electric device and fourth terminal plates of said circuit board under pressure respectively when said female connector is connected with said male connector and said circuit board.

3. The female connector as claimed in claim 1 further comprising:

an outside member for accommodating said case member, said case member being movable within said outside member.

4. The female connector as claimed in claim 3 further comprising a plurality of second terminal members disposed in said case member symmetrically to said first terminal members, each having a second base portion, a third terminal portion extending from said second base portion and a fourth terminal portion extending from said second base portion toward said circuit board, wherein said second wall member has a plurality of second slits;

said pedestal portion has a plurality of second parallel grooves extending in the longitudinal direction thereof to be connected to said second slits respectively;

each said second base portion is inserted in one of said second grooves, each said third terminal portion is to be inserted to one of said second slits;

said third and fourth terminal portions are in contact with third terminal plates of said electric device and fourth terminal plates of said circuit board under pressure respectively when said female connector is connected with said male connector and said circuit board.

5. The female connector as claimed in claim 3, wherein said case member has a projection member; and said outside member has holes in engagement with said projection member.

6. The female connector as claimed in claim 1, wherein said pedestal portion comprises a hook member and a wall member disposed in said first grooves; and said first base portion of said plurality of first terminal members has an edge portion held in said first grooves retained by said hook member and said wall member.

* * * * *